US011296408B1

(12) United States Patent
Bondyopadhyay

(10) Patent No.: US 11,296,408 B1
(45) Date of Patent: Apr. 5, 2022

(54) HIGH SPEED CLUSTER SCANNING WITH GEODESIC SPHERE PHASED ARRAY ANTENNA SYSTEM

(71) Applicant: Probir Kumar Bondyopadhyay, Houston, TX (US)

(72) Inventor: Probir Kumar Bondyopadhyay, Houston, TX (US)

(73) Assignee: Probir Kumar Bondyopadhyay, Houston, TX (US)

( * ) Notice: Subject to any disclaimer, the term of this patent is extended or adjusted under 35 U.S.C. 154(b) by 0 days.

(21) Appl. No.: 16/974,170

(22) Filed: Oct. 29, 2020

(51) Int. Cl.
*H01Q 3/24* (2006.01)

(52) U.S. Cl.
CPC ..... *H01Q 3/242* (2013.01)

(58) Field of Classification Search
None
See application file for complete search history.

(56) References Cited

U.S. PATENT DOCUMENTS 4,026,078 A * 5/1977 Ahern ..... E04B 1/3211 52/81.4
4,996,536 A * 2/1991 Broadhurst ..... H01Q 15/18 343/912
5,907,931 A * 6/1999 Sun ..... E04B 7/107 52/81.4
6,292,134 B1 * 9/2001 Bondyopadhyay .. H01Q 21/205 342/374
6,295,785 B1 * 10/2001 Herrmann ..... E04B 1/3211 52/81.3
8,229,237 B2 * 7/2012 Sahr ..... G01C 21/20 382/241
8,594,735 B2 * 11/2013 Huang ..... H01Q 3/2605 455/562.1
8,743,015 B1 * 6/2014 West ..... H01Q 1/12 343/878
8,779,983 B1 * 7/2014 Lam ..... H01Q 21/061 343/700 MS
9,311,350 B2 * 4/2016 Sahr ..... G06F 16/29
9,720,881 B2 * 8/2017 Schein ..... G09B 23/04
10,038,252 B2 * 7/2018 West ..... H01Q 21/0087
10,417,820 B2 * 9/2019 Samavati ..... G06T 17/05
2009/0284408 A1 * 11/2009 Bernhardt ..... B64G 1/105 342/174
2010/0079347 A1 * 4/2010 Hayes ..... H01Q 3/2682 343/705
2010/0079354 A1 * 4/2010 Lam ..... H01Q 19/06 343/909
2019/0129006 A1 * 5/2019 Harman ..... G01S 13/56
2019/0260120 A1 * 8/2019 Khushrushahi ..... H01Q 19/062
2021/0273345 A1 * 9/2021 Moon ..... H01Q 9/0407

* cited by examiner

*Primary Examiner* — Ab Salam Alkassim, Jr.

(57) ABSTRACT

Invention of electronic cluster scanning method for Geodesic Sphere Phased Array Antenna System that is simultaneously faster cheaper and simpler is presented in this patent. This invention is based on recognition and skillful exploitation of multi-level symmetry properties inherent in the truncated icosahedron based geodesic sphere phased array antenna structure described in an earlier invention. The cluster scanning method employs cluster switching with limited angle electronic scanning involving inter-twined hexagonal sub-array centered clusters and pentagonal sub-array centered clusters.

12 Claims, 5 Drawing Sheets

HIGH SPEED CLUSTER SCANNING WITH GEODESIC SPHERE PHASED ARRAY ANTENNA SYSTEM

FIELD OF THE INVENTION

The field of this invention, in general, is high speed electronic scanning Phased Array Antenna System, for applications in radar and multi-satellite communication systems. In particular, this invention deals with new method and technique of design, manufacturing, operation and maintenance of an electronic scanning Geodesic Sphere Phased Array Antenna System that is simultaneously simpler, cheaper and faster.

BACKGROUND OF THE INVENTION

Electronic scanning Phased Array Antennas are designed and operated to set up and electronically move electromagnetic beams for simultaneous radar functions of acquisitions and tracking, and communications, with multiple moving objects in space near and far. The same phased array antenna performs simultaneous transmit and receive functions. The speed with which such electromagnetic beams could be electronically set up and moved by digital computers is of paramount practical importance. This inventor's prior invention of the Geodesic Sphere Phased Array Antenna System, described in U.S. Pat. No. 6,292,134 that perform all the stated functions, is at focus here for the realization of the unique design of the electronic scanning phased array antenna system that is simultaneously simpler, cheaper and faster.

Wireless wizard Guglielmo Marconi was the world's first in using array antennas for long distance wireless communication across the Atlantic ocean in December 1901. Driven by the urgent needs for national Defense, research, development and deployment works with electronic scanning phased array antenna began after the end of World War II in 1945. The Geodesic Sphere Phased Array Antenna System of 2001 described in U.S. Pat. No. 6,292,134 has structural symmetries inherently existing at multiple levels that are the singular focus of attention in this invention for realization of the electronic scanning phased array antenna system that is simultaneously simpler, cheaper and faster in design, construction, operation and maintenance.

With the stated objectives in mind, all kinds of geodesic spherical structures mentioned in U.S. Pat. No. 6,292,134 are examined to discover that truncated icosahedron based geodesic spherical structure is the unique one that can be used to construct simpler and cheaper phased array antenna system. Taking notice of the fact that the entire geodesic spherical structure comprises of twelve regular identical pentagonal panels and twenty regular identical hexagonal panels, the entire phased array antenna hardware design works reduces to the design of one such pentagonal sub-array antenna panel and one such hexagonal one.

Associated with each of the large number of antenna elements of the phased array are digital amplitudes and phases of the electromagnetic transmit and receive signals. Setting up the electromagnetic beam digitally and moving it in various desired directions involve digital computations in real time by a digital computer.

With tremendous advancements in digital data storage technologies in the past half a century, a vast amount of data required to set up and move the electromagnetic beams in set directions, pre-calculated data could be stored for immediate use in real time.

Therefore, high-speed operational requirement for the phased array radar translates into low-angle electronic scanning which together with beam-switching capability afforded by simultaneously changing the excited portions of the phased array, allow omni-directional or very wide-angle electronic scanning of the outer space. The present invention just does that as described next.

SUMMARY OF THE INVENTION

The present invention is a new method of high speed electronic scanning (christened cluster-scanning) by phased array antenna mounted on geodesic spherical structure based on truncated icosahedron. This invention originates from the recognition of multi-level symmetry properties inherent in the three dimensional geometry of the truncated icosahedron based Geodesic Sphere Phased Array antenna structure and their full skillful utilizations in the design, manufacturing and efficient high-speed electronic scanning operations by a digital computer.

This invention is based on the recognition that the truncated icosahedron based geodesic phased array antenna structure comprises of two kinds of inter-twined clusters of sub-arrays. The first kind of cluster is a regular pentagonal sub-array panel immediately surrounded by five identical regular hexagonal sub-array panels. Whereas the second kind of cluster comprises of a regular hexagonal sub-array panel immediately surrounded alternatively by three identical regular hexagonal sub-array panels and three identical regular pentagonal sub-array panels.

In this cluster scanning technique invented here, the phased array antenna is so designed and constructed that only a sub-array cluster is energized to set up the electromagnetic transmit or receive beam that will only scan electronically the space that comes within the conical scan volume subtended by the central sub-array panel of the said cluster. This electronic cluster scanning is achieved through adjustments of digital amplitudes and phase settings of its antenna elements electronically by a digital computer.

A conical space subtended by a sub-array panel of the geodesic sphere phased array is scanned by the corresponding sub-array cluster. Thus this invented phased array antenna system scans the entire required scan space by clusters with small angle electronic scanning and cluster switching. Narrow angle scanning permits computed digital data storage of the amplitude and phase settings of the antenna elements of the cluster for setting up the antenna beam in a particular direction thus eliminating real time computations. The cluster-scanning technique is thus high-speed.

The word 'sphere' in Geodesic Sphere Phased Array Antenna System is an adjective, meaning 'spherical structure' and the word's meaning is not restricted to the full sphere.

DETAILED DESCRIPTION OF THE INVENTION

Figure 1:
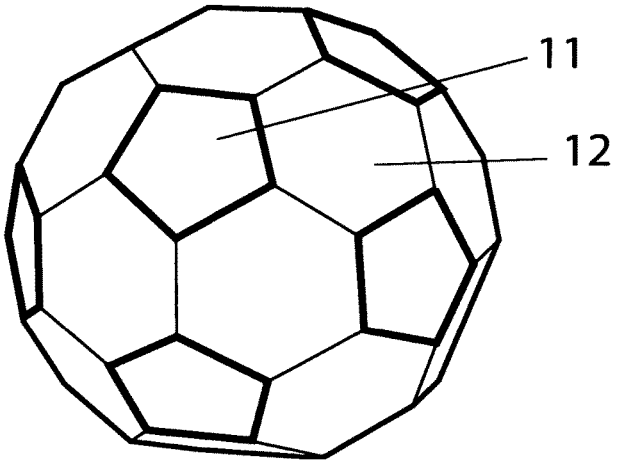
FIG. 1 Geodesic Sphere phased array antenna structure based on truncated icosahedron, an Archimedean semi-regular solid, comprising of 12 identical regular pentagonal panels and 20 identical regular hexagonal panels.

The present invention is a new high speed electronic scanning method (christened cluster scanning method) for truncated icosahedron based geodesic spherical phased array antenna system that results in the realization of the system that is simultaneously simpler, cheaper and faster in design, construction, operation and maintenance. The truncated icosahedron based geodesic sphere phased array antenna structure is shown in FIG. 1 and is a prior invention of the present inventor described in U.S. Pat. No. 6,292,134. Subsequent discovery of unique symmetry properties inherent in this geodesic spherical structure at multiple levels has been skillfully harnessed to arrive at the present invention. This Phased array antenna mounted on the truncated icosahedron (an Archimedean semi regular solid) based full geodesic spherical structure comprises of twelve (12) identical regular planar pentagonal sub-array panels (11) and twenty (20) identical regular planar hexagonal sub-array panels (12) of antenna elements as shown in FIG. 1.

Figure 2:
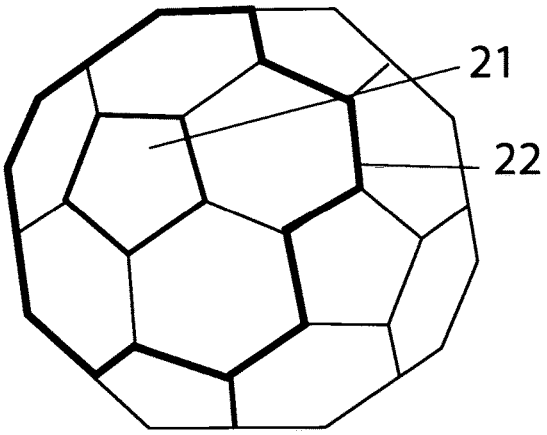
FIG. 2 Regular pentagonal sub-array panel centered sub-array cluster comprising of five regular identical hexagonal sub-array panels immediately surrounding the regular pentagonal sub-array panel at the center.
Figure 3:
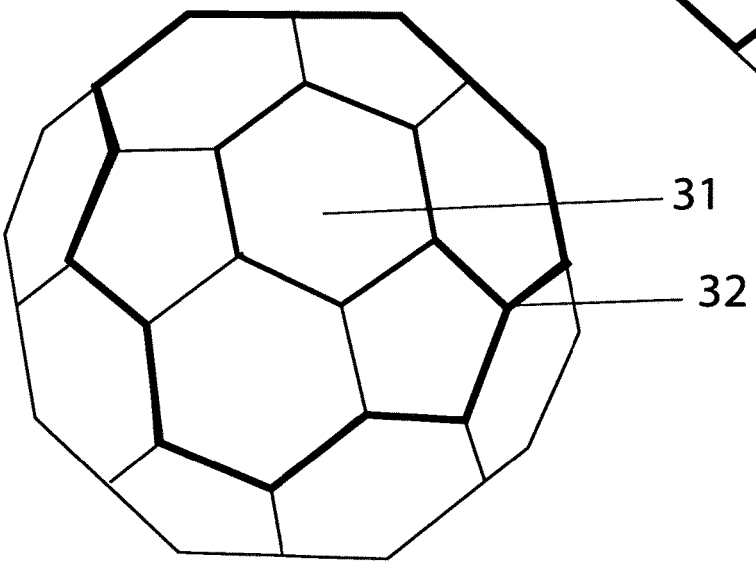
FIG. 3 Regular hexagonal sub-array panel centered sub-array cluster comprising of three regular identical hexagonal sub-array panels and three regular identical pentagonal sub array panels alternatively surrounding immediately the regular hexagonal sub-array panel at the center.

Discovery of global symmetry inherent in the structure led to the recognition that the phased array antenna, mounted on the said geodesic spherical structure, comprises of only two kinds of identical inter-twined sub-array clusters. One of them is a regular planar pentagonal sub-array (21) immediately surrounded by five regular identical hexagonal sub-arrays (22). This six sub-array cluster is shown in FIG. 2. The other cluster is a regular planar hexagonal sub-array (31) immediately surrounded alternatively by three regular identical planar hexagonal and three regular identical planar pentagonal sub-arrays. This seven sub-array cluster (32) is shown in FIG. 3.

Figure 4:
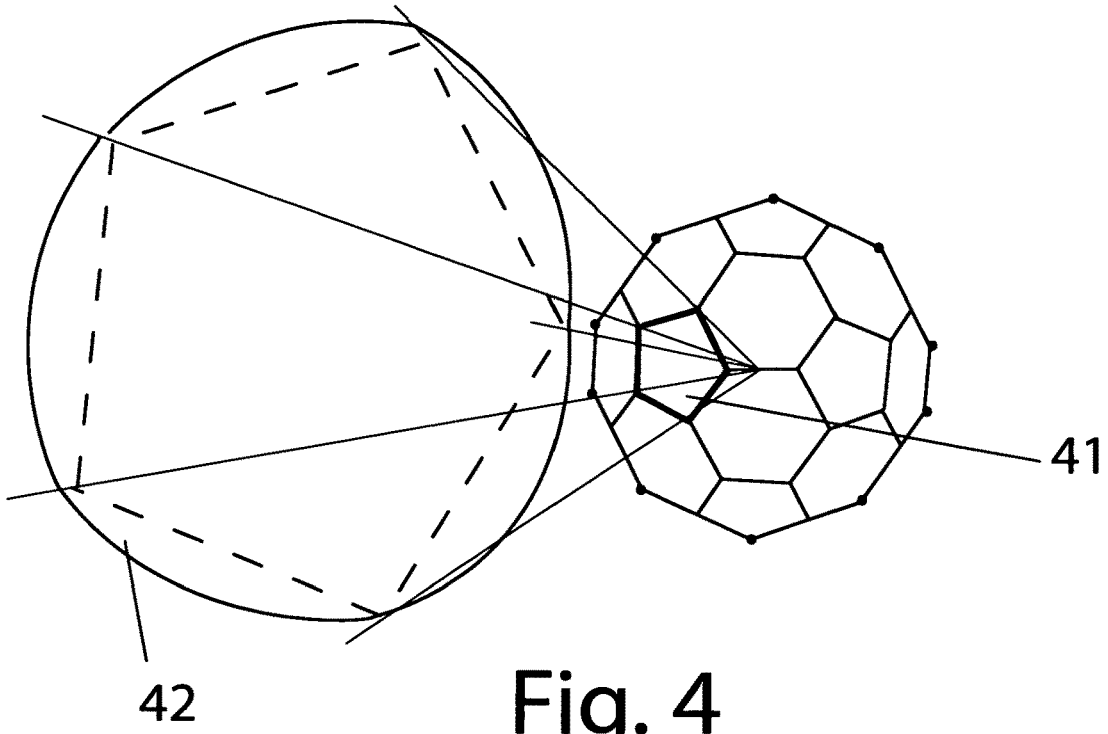
FIG. 4. Conical outer space for electronic scanning by the six sub-array antenna cluster. This scan space is subtended by the central regular pentagonal sub-array, of the geodesic sphere phased array antenna system.
Figure 5:
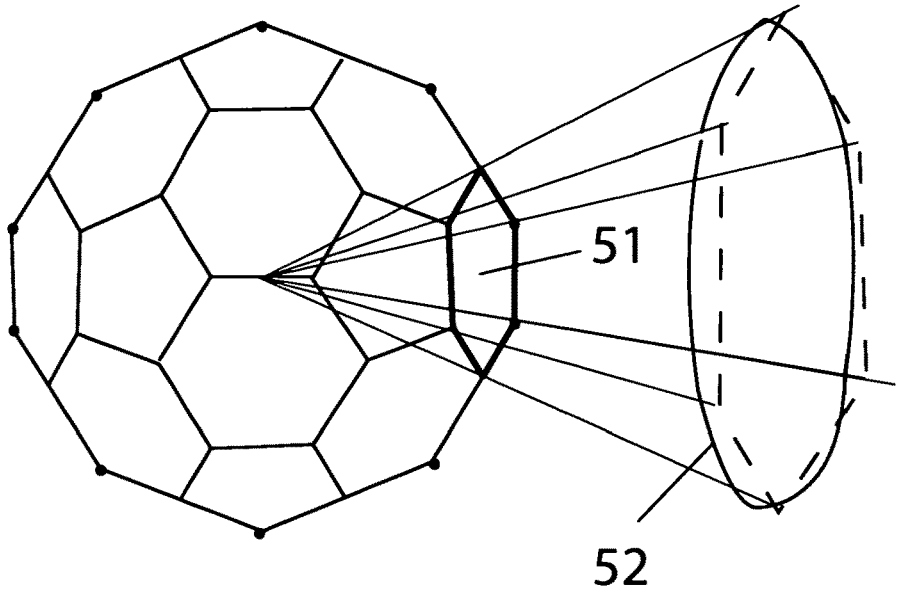
FIG. 5. Conical outer space for electronic scanning by the seven sub-array antenna cluster. This scan space is subtended by the central regular hexagonal sub-array, of the geodesic sphere phased array antenna system.

This very important discovery immediately led to the momentous invention of the cluster scanning technique, for the phased array antenna system, harnessed in two steps. In the first step of this invention, the entire omni-directional communication space in spherical coordinate frame, outside of the antenna system, is divided into 12 conical cells (42) subtended by each (41) of the 12 regular pentagonal sub-arrays (as shown in FIG. 4) and 20 conical cells (52) subtended by each (51) of the 20 regular hexagonal sub-arrays (as shown in FIG. 5) totaling 32 cellular regions in the outer scan space.

Omni-directional communication space that truly refers to the entire outer space, is defined, in spherical coordinate frame (r, theta, phi), to be 0° to 360° in azimuth (phi), and 0° to 180° in elevation (theta). This refers to the Geodesic Sphere Phased Array Antenna System operating in space, like being in an earth orbit communicating to a space object above that orbit as well as to the ground below. Whereas, if the Geodesic Sphere Phased Array Antenna System is ground based on an elevated platform, the term omni-directional operation refers to elevation angles(theta) running from 0 degree (zenith) through many degrees beyond 90 degrees (horizon) downwards.

The immediate simultaneous second part of the invention is to establish the regular pentagonal sub-array centered six sub-array antenna cluster as the transmit/receive antenna that will be energized to scan only the conical scan volume subtended by the said central pentagonal sub-array; and establish the regular hexagonal sub-array centered seven sub-array antenna cluster as the transmit/receive antenna that will be energized to scan only the conical scan volume subtended by the said central hexagonal sub-array. The entire communication space is therefore, covered by electronic cluster scanning successively followed by electronic cluster switching. According to the present invention, the sub-array cluster of either type must be correctly designed to produce the necessary electromagnetic beams for robust communications and radar functions.

Figure 6:
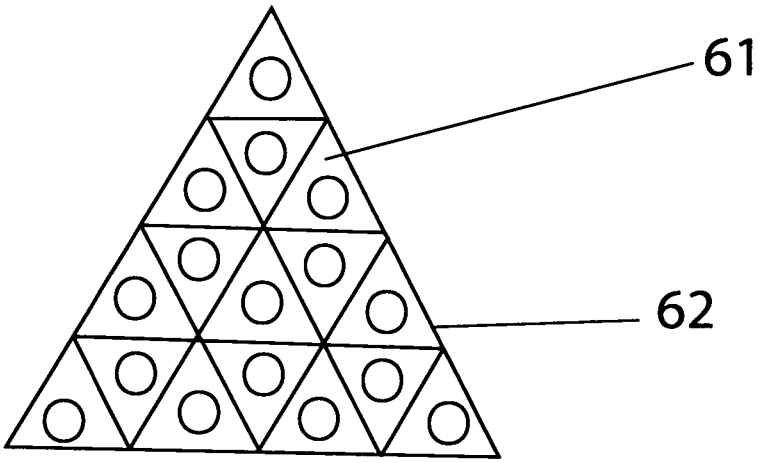
FIG. 6. Antenna element arrangements in each of the six equilateral triangular sub-arrays of the hexagonal sub-array panels of the geodesic sphere phased array antenna system.
Figure 7:
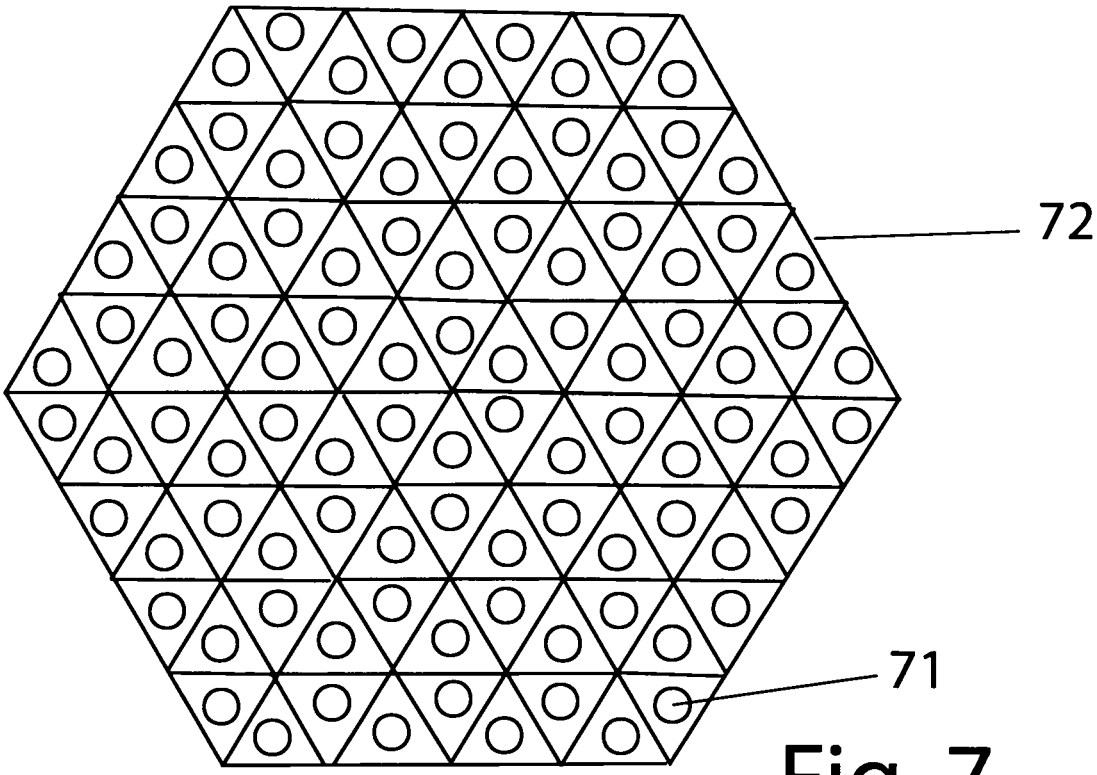
FIG. 7. Regular hexagonal sub-array of antenna elements in equilateral triangular unit cells. The unit cells are obtained by successively bisecting sides of the larger equilateral triangular spaces on the surface of the hexagonal sub-array.
Figure 8:
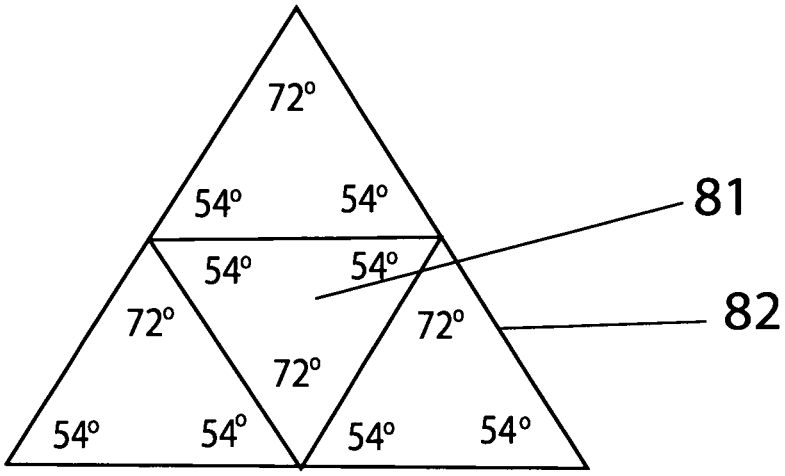
FIG. 8. Angular relations in one of the five isosceles triangular sub-arrays of the pentagonal sub-array panels of the geodesic sphere phased array antenna system.
Figure 9:
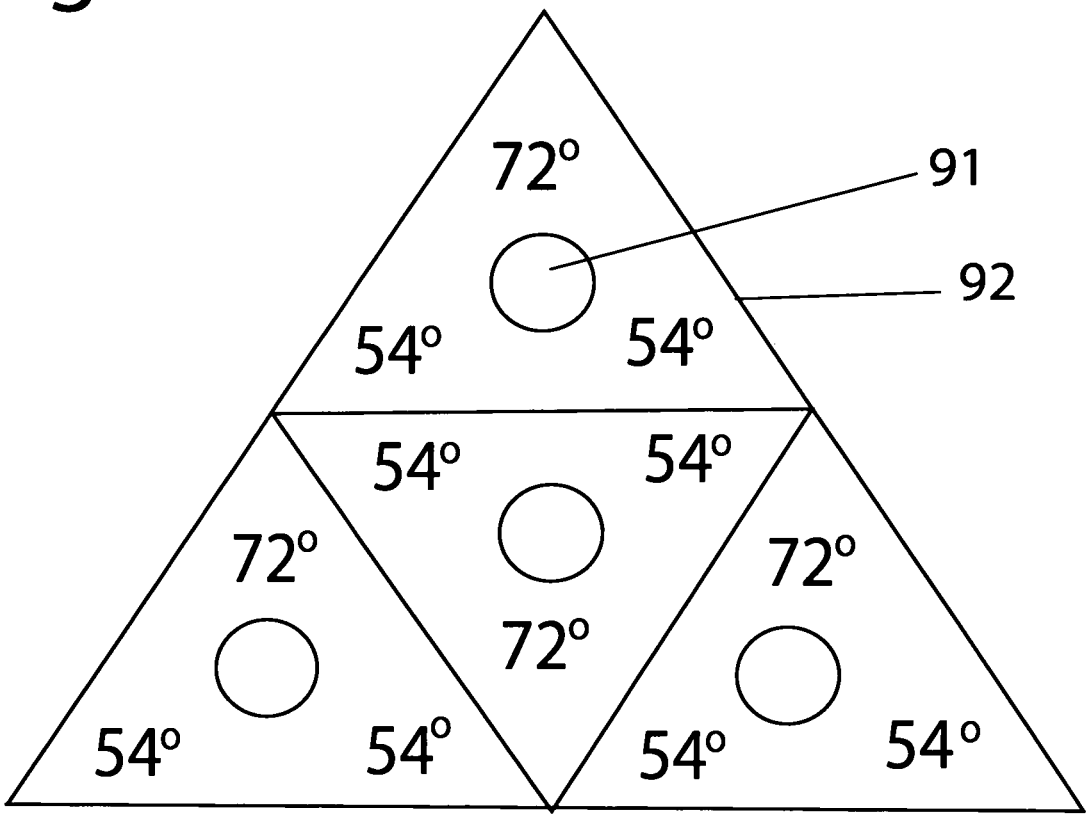
FIG. 9. Antenna element in a unit cell arrangements in one of the five isosceles triangular sub-array of unit cells. The unit cells are obtained by successively bisecting sides of the larger isosceles triangular spaces on the surface of the pentagonal sub-array.
Figure 10:
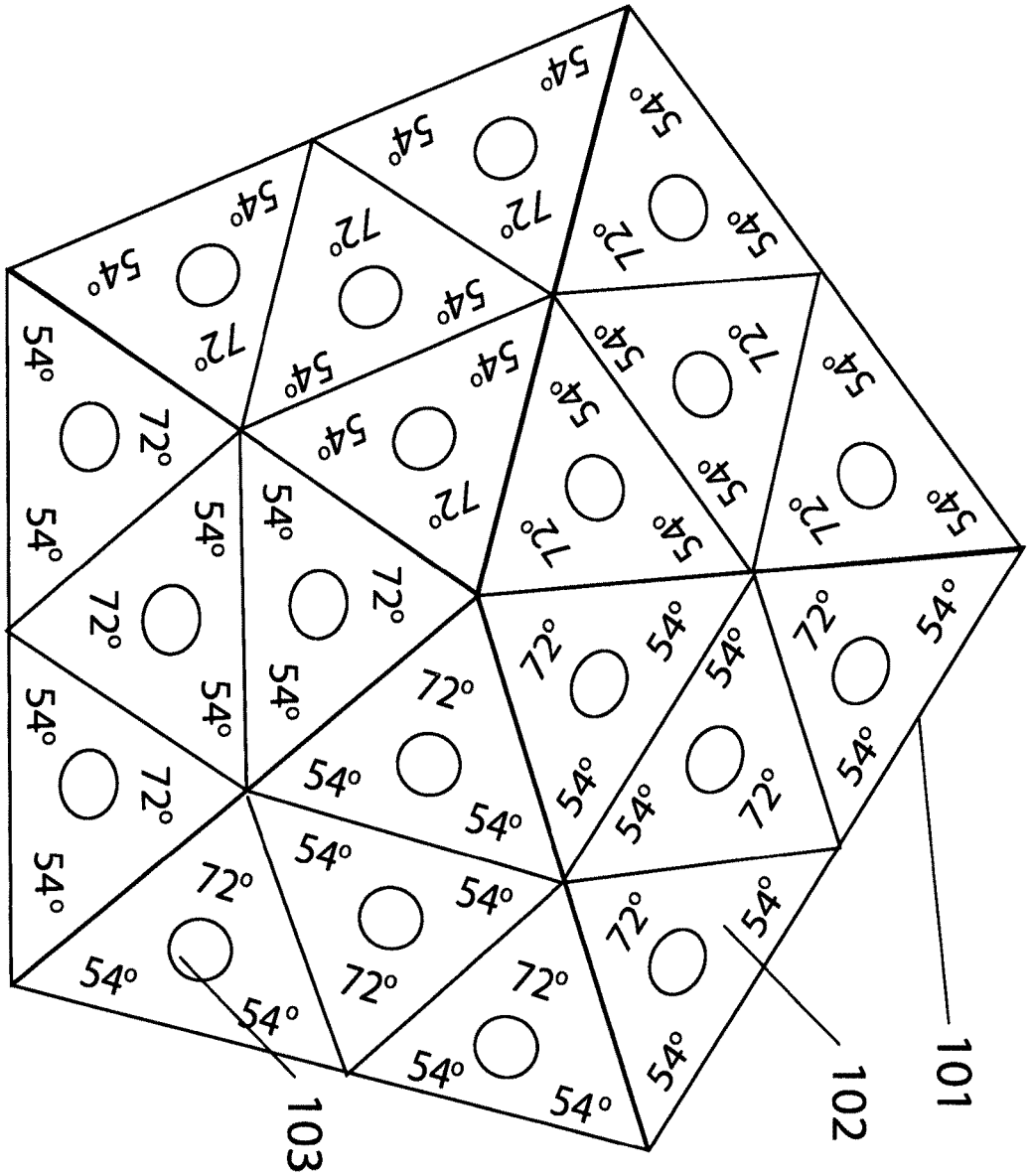
FIG. 10. Regular pentagonal sub-array with twenty antenna elements symmetrically arranged, in identical isosceles triangular unit cells.

Recognition of structural symmetry properties inherently existing in the regular hexagonal sub-arrays, all identical, lead to the arrangement of antenna elements in identical equilateral triangular unit cells (61). This is achieved by successive bisections of the three sides (62) of the constituent six equilateral triangular spaces. This is shown in FIG. 6 and FIG. 7. Number of antenna elements (71) in each of the six equilateral triangular spaces (72), therefore, comes in power of two. Similarly, recognition of structural symmetry properties inherently existing in the regular pentagonal sub-arrays, all identical, lead to the arrangement of antenna elements in identical isosceles triangular (82) unit cells (81) as shown in FIG. 8. This is achieved by successive bisections of the three sides (92) of the constituent five isosceles triangular spaces. This is shown in FIG. 9 and FIG. 10. Number of antenna elements (91 and 103) in the unit cell (102) each of the five isosceles triangular spaces (101), therefore, comes in power of two.

This invention, next, recognizes the rotational symmetries of all the sub-array clusters around their own axes which is defined as the outward radial direction through the center of each of the cluster's central sub-array. Since narrow-angle electronic cluster scanning by each of the sub-array clusters takes place around the cluster axis, this rotational symmetry is harnessed so as to reduce the amount of amplitude and phase settings data to be computed and stored for the elements of the clusters for setting up and movements of the transmit/receive electromagnetic radiation beams. High speeds in the invented cluster scanning method result from correctly harnessing the advantages of all the three stated symmetry properties of this unique phased array antenna system. The stage is now set for the design of the high-speed electronic cluster scanning phased array antenna system just invented.

Antenna elements of the sub-array cluster are electromagnetically excited with appropriate amplitude and phase distributions to produce the required electromagnetic beam either in the transmit or in receive mode in the required frequency band of application. The beam width required is related to the sub-array cluster antenna Gain in the direction of its central axis. For a particular application of the phased array antenna system robust communication link analysis determines the cluster antenna Gain.

Number of cluster array antenna elements required, is determined by the required beam width or the antenna Gain of the sub-array cluster. This, in turn, determines the radius of the Geodesic Sphere Phased Array Antenna Structure as further explained below.

The regular hexagonal sub-array panel comprises of six equilateral triangular sub-arrays each comprising of $4^n$ antenna elements, where n=0, 1, 2, 3, 4 . . . . Therefore, the hexagonal sub-array panel comprises of a total of $6\times4^n$ antenna elements where the antenna element unit cell is a smaller equilateral triangle.

Whereas, The regular pentagonal sub-array panel comprises of five isosceles triangular sub-arrays each comprising of $4^n$ antenna elements, where n=0, 1, 2, 3, 4 . . . . The isosceles triangle has the three angles to be 72°, 54°, and 54° (FIG. 8). Therefore, the pentagonal sub-array panel comprises of a total of $5\times4^n$ antenna elements where the antenna element unit cell is a smaller isosceles triangle with three angles to be 72°, 54°, and 54° for all elements in the said pentagonal sub-array panel.

The total number of antenna elements in the six sub-array cluster with the pentagonal sub-array at the center is $5\times4^n+5\times6\times4^n=35\times4^n$. Whereas, the total number of antenna elements in the seven sub-array cluster with the hexagonal sub-array at the center is $3\times5\times4^n+4\times6\times4^n=39\times4^n$ [n=0, 1, 2 . . . ]. The number n represents the number of times the constituent equilateral (or isosceles) triangular sides of the hexagonal (or pentagonal) sub-array is bisected. Both the regular pentagonal sub-array panels and identical regular hexagonal sub-array panels have the same edge lengths a.

Very good modeling and electromagnetic analysis of the geodesic sphere phased array antenna generates a mathematical expression connecting the phased array antenna Gain, number of antenna elements, center wavelength of the frequency band, antenna element size, radius of the geodesic sphere and the side length of the hexagonal (and pentagonal) sub-arrays.

Therefore, communication link analysis for robust communication or radar functions determines the phased array antenna Gain (and beam width) which, then, determines the electrical size (electrical radius kR, where $k=2\pi/\lambda$) of the Geodesic Sphere and total number of elements to be used to meet the specific antenna performance requirement [λ is the wavelength corresponding to the center frequency of the communication signal band and R is the physical radius of the Geodesic Sphere].

For the Geodesic Sphere in the preferred embodiment, the side a of the regular pentagonal sub-array panel as well as the regular hexagonal sub-array panel is related to the physical radius R of the Geodesic Sphere are related.

The maximum scan angle ($\text{Theta}_{max}$) for the six unit cluster with the pentagonal sub-array at the center of the cluster is $$\text{Theta}_{max}=2\sin^{-1}[a/(4R\cos 54°)]=19.77°$$

$$R=2.47801866\ a$$

Whereas, the maximum scan angle for the seven unit cluster with the hexagonal sub-array at the center of the cluster is $$\text{Theta}_{max}=2\sin^{-1}[a/(2R)]=23.3°$$

Where R is the radius of the circumscribing Geodesic Sphere and a is the side of the sub-array panels, hexagonal and pentagonal.

If the required amplitude and phase settings of the antenna elements are pre-calculated and stored in the memory of the computer, then computations in real time will not be required to set up and move the beam. The electronic scanning operations can, therefore, be made very high speed. The global symmetry and rotational symmetry properties inherent in the Geodesic Spherical array structure drastically reduce the amount of required amplitude and phase settings data to be stored and thus play the critical role in high speed operation of the Phased Array antenna invented and described here.

The invention claimed is:

1. A geodesic sphere phased array system using high-speed electronic cluster scanning for acquisition, tracking of aerial objects, and for multi-satellite communications, the geodesic sphere phased array system comprising:

a Geodesic spherical structure based on a truncated icosahedron, an Archimedean semi-regular solid, a plurality of regular planar hexagonal and regular planar pentagonal sub-array panels of planar antenna element unit cells mounted on the said geodesic spherical structure, an antenna element placed in each unit cell, transmit and receive signal processing means connected to each said planar antenna element unit cells of each said regular planar pentagonal sub-array panels and each said regular planar hexagonal sub-array panels for simultaneous transmission and reception of signals;

an electromagnetic signal feed means connected to each said planar antenna element unit cell of each said sub-array panel for forming at least one electromagnetic beam in space;

electronic switching means for selectively connecting each said sub-array panel to adjacent sub-array panels for generating one or multiple electromagnetic beams in selective diverse directions in space;

electronic phase shifting means connected to each said planar antenna element unit cell of each said sub-array panel for providing electronic scanning capability to said sub-array panels of antenna element unit cells connected by said electronic switching means, with a space the phased array system communicates in being segmented into a plurality of smaller cellular spaces;

each said cellular communication space for electronic scanning being defined by the central sub-array panel of a cluster of contiguous sub-array panels of antenna element unit cells mounted on the said geodesic spherical phased array structure and each said cellular communication space adapted to be electronically scanned by the said cluster corresponding to the said cellular communication space, a digital computer for storing amplification and phase-shifting digital data for each element unit cells, electromagnetic beam forming and shifting algorithms for electronic control, and overall operation of the said phased array antenna system;

said geodesic spherical structure comprising of a plurality of regular planar pentagonal sub-array centered clusters inter-twined with regular planar hexagonal sub-array centered sub-array clusters;

wherein the planar antenna element unit cells of the regular planar pentagonal sub-array panels are isosceles triangles of angles 72°, 54°, and 54°; and wherein the planar antenna element unit cells of the regular planar hexagonal sub-array panels are equilateral triangles.

2. The geodesic sphere phased array system as claimed in claim 1, wherein said regular pentagonal sub-array centered clusters comprises of a said central regular pentagonal sub-array immediately surrounded by five regular hexagonal sub-arrays in the said geodesic spherical structure.

3. The geodesic sphere phased array system as claimed in claim 1, wherein said regular hexagonal sub-array centered clusters comprises of a said central regular hexagonal sub-array immediately surrounded alternatively by three regular hexagonal sub-arrays and three regular pentagonal sub-arrays in the said geodesic spherical structure.

4. The geodesic sphere phased array system as claimed in claim 1, said the entire communication space comprising of twelve identical conical exterior space segments subtended by twelve regular planar pentagonal sub-array panels and twenty identical conical exterior space segments subtended by twenty regular planar hexagonal sub-array panels totaling thirty-two distinct conical exterior space segments.

5. The geodesic sphere phased array system as claimed in claim 4 wherein each of the space segments subtended by the regular pentagonal sub-array panels is the electronic scanning communication space for each said corresponding regular pentagonal sub-array centered cluster.

6. The geodesic sphere phased array system as claimed in claim 4 wherein each of the space segments subtended by the regular hexagonal sub-array panels is the electronic scanning communication space for each said corresponding regular hexagonal sub-array centered cluster.

7. The geodesic sphere phased array system as claimed in claim 2 wherein the said regular planar pentagonal sub-array centered clusters are transmit antennas for high speed cluster scanning.

8. The geodesic sphere phased array system as claimed in claim 3 wherein the said regular planar hexagonal sub-array centered clusters are transmit antennas for high speed cluster scanning.

9. The geodesic sphere phased array system as claimed in claim 7 wherein the said regular planar pentagonal sub-array centered clusters are also receive antennas for high speed cluster scanning.

10. The geodesic sphere phased array system as claimed in claim 8 wherein the said regular planar hexagonal sub-array centered clusters are also receive antennas for high speed cluster scanning.

11. The geodesic sphere phased array system as claimed in claim 1, wherein the planar antenna elements are dual frequency band dual circular polarized corresponding to transmit and receive modes of electromagnetic signal communications.

12. The geodesic sphere phased array system as claimed in claim 1 where the said geodesic spherical structure in its entirety comprises of twenty regular planar hexagonal sub-array centered clusters inter-twined with twelve regular planar pentagonal sub-array centered clusters.

* * * * *